United States Patent [19]

Ruhl

[11] Patent Number: 4,470,297

[45] Date of Patent: Sep. 11, 1984

[54] CAMBER-MONITORING TENSIOMETER

[75] Inventor: Robert C. Ruhl, Cleveland Heights, Ohio

[73] Assignee: Kennecott Corporation, Cleveland, Ohio

[21] Appl. No.: 435,935

[22] Filed: Oct. 22, 1982

[51] Int. Cl.[3] ..... G01L 5/04

[52] U.S. Cl. ..... 73/159; 73/862.07

[58] Field of Search ..... 73/862.07, 159, 862.45, 73/862.47, 862.48; 72/19

[56] References Cited

U.S. PATENT DOCUMENTS

| | | | |
|---|---|---|---|
| 2,343,229 | 2/1944 | Stone et al. | 73/862.45 |
| 2,345,765 | 4/1942 | Michel | 80/35 |
| 2,544,467 | 3/1951 | Michel | 80/35 |
| 2,809,519 | 10/1957 | Kaestner | 73/159 |
| 2,931,962 | 4/1960 | Huck | 73/862.45 X |
| 3,279,246 | 10/1966 | Seasholtz | 73/862.45 X |
| 3,499,306 | 3/1970 | Pearson | 72/17 |
| 4,262,511 | 4/1981 | Boisvert et al. | 72/17 |

*Primary Examiner*—Charles A. Ruehl
*Assistant Examiner*—Brian R. Tumm
*Attorney, Agent, or Firm*—R. Lawrence Sahr

[57] ABSTRACT

A device for monitoring the flatness or camber of a moving metal strip is disclosed. The device includes a cylindrical roller over which the metal strip travels, which cylindrical roller is independently supported at each end on a plate which is pivotally mounted on top of a housing for two load cells situated on opposite sides of the centerline of the strip product. The projections provided on the underside of the plate bear against the load cells in a manner whereby any difference in tension across the width of the strip may be detected as a difference in pressures exerted on the two load cells.

8 Claims, 2 Drawing Figures

CAMBER-MONITORING TENSIOMETER

BACKGROUND OF THE INVENTION

1. Field of the Invention

This invention relates in general to the cold rolling of metal strip. More specifically, it relates to a system for controlling the tension and camber (flatness) of the strip product.

2. The Prior Art

Camber defines the amount of edge curvature of a strip width of rolled sheet metal with reference to a straight edge. The prior art discloses a number of devices for effecting control of the strip camber. Typically, these prior art systems change the shape of one of the metal working rolls, by changing the temperature profile of the roll, responsive to signals received from a sensing element which monitors the strip product. U.S. Pat. No. 4,262,511 issued to Boisvert et al, for example, discloses a "shapemeter" in the form of a segmented rotor supported by an air cushion and in contact with the sheet metal product. Pneumatic signals from the segmented rotor are converted into electrical signals which, in turn, control the distribution of coolant onto the metal roll surfaces. The teachings of U.S. Pat. No. 3,499,306 issued to Pearson are somewhat similar.

The "shapemeters" of the two aforementioned patents, as noted above, are designed to operate in cooperation with apparatus for changing the profile of the working roll by changing distribution of coolant and the temperature profile of the roll. While such devices may successfully monitor shape across wide sheets, they are ineffective with narrow strip because the thermal gradient across the face of the roll over a distance corresponding to the width of the narrow strip is insignificant.

Conventional "tensiometers" simply monitor tension in the strip intermediate adjacent roll stands operating in tandem and have no capability for monitoring chamber. See, for example U.S. Pat. Nos. 2,345,765 and 2,544,467 issued to Michel.

Accordingly, it is an object of the present invention to provide a simple, relatively maintenance-free device for detection and continuous monitoring of the camber of a moving metal strip.

It is another object of the present invention to provide a tensiometer which has both tension measuring and camber measuring capabilities.

Yet another object is to provide a device for monitoring camber of a narrow strip.

Other objects and further scope of applicability of the present invention will become apparent from a reading of the detailed description to follow, taken in conjunction with the accompanying drawings.

SUMMARY OF THE INVENTION

The present invention provides a tensiometer for measuring the camber and, optionally, tension of a moving metal strip. It can be used in conjunction with any cold rolling mill. When used in combination with the roll stand of the commonly owned copending application entitled "COLD ROLLING MILL FOR METAL STRIP" (Application Ser. No. 435,981, filed on Oct. 22, 1983), the teachings of which are incorporated herein by reference, control circuitry associated with the tensiometer, generates a command signal for operating at least one of the gap adjusting devices disclosed therein in a manner which changes the tilt of the movable working roll with respect to the other roll.

The tensiometer of the present invention includes a cylindrical roller for support of the sheet metal strip under tension. The cylindrical roller is mounted through bearings and independent support means at each end thereof to a plate which loosely covers a housing for two load cells mounted therein on opposite sides of the centerline of the rolled metal strip. A flexible membrane covers the open top of the housing and the load cells. The plate which carries the cylindrical roller is supported on the housing at a pivot point and by projections on the underside of the plate which bear against the respective load cells through the flexible membrane. With this arrangement, the plate and the cylindrical roller mounted thereon pivot about an axis perpendicular to the centerline of the rolled metal strip. The tensiometer may be used to monitor the strip tension as a function of the total loading on the load cells and/or to monitor strip camber as a function of the difference between the pressures exerted on the two load cells.

The present invention is especially useful in generating the camber control signal utilized in the control circuitry for automatic camber control (ACC) as taught by the aforementioned copending application. The camber control signal generated by the tensiometer of the present invention represents the difference between the forces exerted on the load cells. In accordance with the teachings of that copending application, a voltage signal representative of that force difference is converted to a value for actual camber which, in turn, is converted to a control signal for repositioning of the gap adjusting devices to provide zero camber. Also, if desired, the tension signal can be used for automatic tension control where it is used to vary the mill speed or the torque on a winder or bridle.

DESCRIPTION OF THE PREFERRED EMBODIMENT

Figure 1:
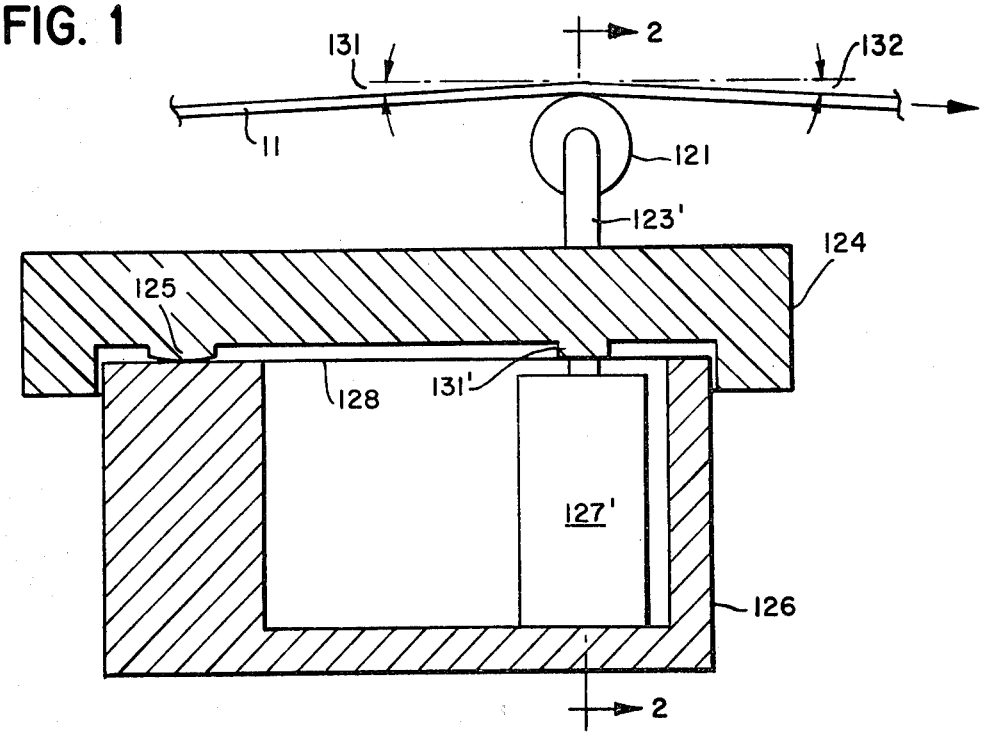
FIG. 1 is a view in vertical section taken along the direction of advance of the metal strip of a camber-monitoring tensiometer according to the present invention.
Figure 2:
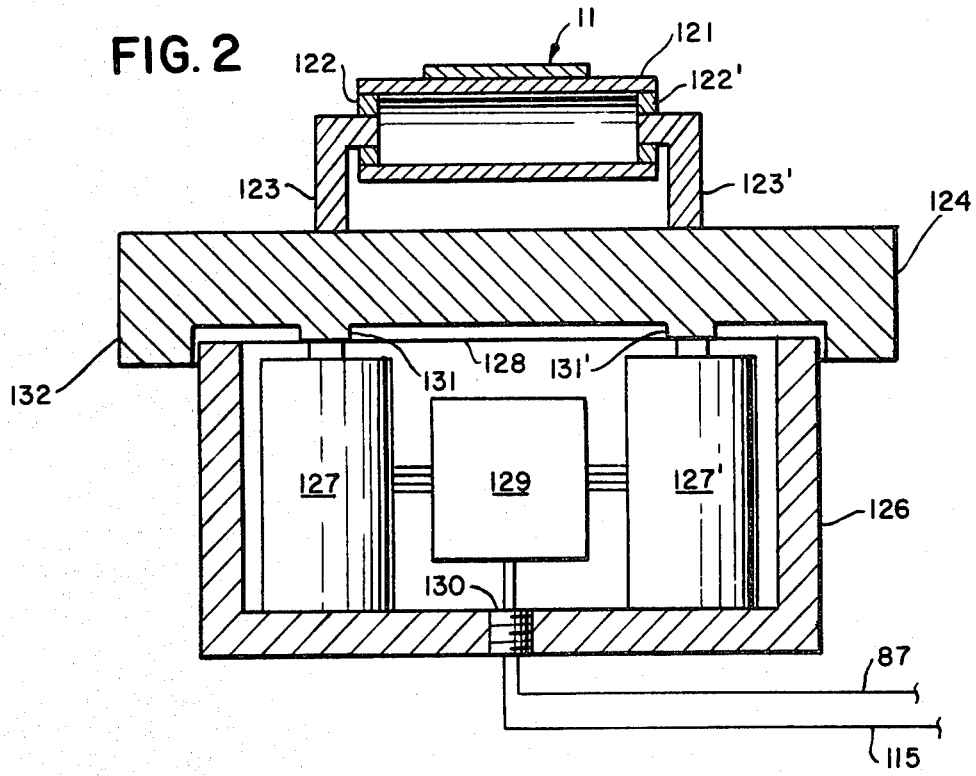
FIG. 2 is a view in vertical section taken along the line 2—2 in FIG. 1.

Referring to FIGS. 1 and 2, which give two sectional elevations of the tensiomenter, the metal strip 11 wraps around a sensing roll 121 with a well-defined wrap angle. The sensing roll 121 is mounted on a movable top plate 124 by two posts 123 and 123', which support precision high-speed bearings 122, 122', allowing the roll 121 to turn with very little friction. The top plate 124 pivots about a pivot button 125 located on the strip centerline. Two additional projections 131 and 131' on the underside of the top plate 124 bear on two high-precision load cells 127 and 127' of the strain-gage type, thus providing a 3-point support for the top plate 124. The top plate 124 is provided with a peripheral flange 132 which overlaps the housing box 126, thus keeping the top plate 124 in place. A very thin membrane seal 128 of brass shim stock is cemented to the top of the housing 126 to form a watertight seal through which the loads may be transferred without significant errors and which covers and protects load cells 127 and 127'. The load cells 127 and 127' are equally spaced on each side of the strip centerline and are wired to a precision amplifier 129. (Optionally, this amplifier may be located remotely from the tensiometer.) The amplifier 129 provides two output signals through a watertight connector 130, which also brings in DC power (not shown) to the amplifier. One output signal 87 is proportional to the sum of the loads on the load cells 127 and 127', while the other output signal 115 is proportional to the difference in the load cell readings and may be either of positive or negative polarity, depending upon which load cell reads the larger load.

The value of signal 87 may be converted to the strip unit tension by the following equation:

$$T = \frac{a(v - vo)}{tw(\tan x + \tan y)} \qquad \text{(Equation 1)}$$

where a=pounds vertical force (sum) per volt (load cell+amplifier gain value)

v=voltage signal 87 (with strip present)

vo=voltage signal 87 (without strip present)

t=strip thickness, inches w=strip width, inches x=angle 131 y=angle 132

T=strip unit tension, pounds/sq. inch

This calculation is performed repeatedly in a computer, as cited below, during operation.

The value of signal 115 may be converted to the camber or curvature of the strip by the following equation:

$$c = \frac{7776\, Sb(e - eo)}{Etw^3(\tan x + \tan y)} \qquad \text{(Equation 2)}$$

where s=load cell spacing, center to center, inches b=pounds vertical force (difference) per volt (load cell+amplifier gain value)

e=signal 115 voltage with strip eo=signal 115 voltage without strip

E=Young's modulus of strip, lb./sq. in.

t=strip thickness, inches w=strip width, inches x=angle 131 y=angle 132 c=camber, chord distance in 6 feet, inches

The above definition of camber as a chord distance is standard in the metal industry. If c=0, the strip is straight. A typical commercial tolerance for c is ±0.5 inches in six feet.

The above equation for c will be true if (a) sufficient tension exists in the strip to elastically stretch it straight and (b) the strip is centered on the tensiometer. In practice, these conditions will be true for small values of c provided the strip guides are well centered and the equipment precisely levelled.

When the value of the camber becomes larger, the strip begins to move on the sensing roll 121 towards the side where the shorter (higher-tension) edge is. This causes the measured camber to slightly exceed the true camber. However when the value of the camber becomes greater still, there is insufficient tension to elastically stretch it flat and then it will tend to lift up on one side and lose contact with one side of the measuring roll altogether, leaving only one edge of the strip riding on the sensing roll. In this case, the measured camber will be less than the actual camber and the edge of the strip not touching the roll will appear "wavy" to the eye. The automatic control procedure described in the aforementioned copending application and works in spite of these factors and, once the camber is small (which it will be with good operating practice), the actual camber will agree closely with the value calculated from voltage 115. The above equation is repeatedly evaluated by a computer during operation.

The preferred embodiment includes a display for the operator of both the camber and tension, even if the system includes an automatic control. The display can be either digital or a pointer. Where an automatic control system is not employed, the operator can monitor the display and make periodic adjustments, as necessary, using manual controls.

This invention may be embodied in other specific forms without departing from the spirit or essential characteristics thereof. The present embodiments are therefore to be considered in all respects as illustrative and no restrictive, the scope of the invention being indicated by the appended claims rather than by the foregoing description, and all changes which come within the meaning and range of equivalency of the claims are therefore intended to be ebraced therein.

I claim:

1. An apparatus for monitoring the flatness of rolled metal strip under tension exiting a rolling mill, said apparatus comprising:

a housing having an open top;

at least two load cells for pressure detection mounted within said housing said load cells being positioned in the housing so that they will be on opposite sides of the centerline of rolled metal strip when said apparatus is centered under rolled metal strip exiting a rolling mill;

a top plate supported on said housing at a pivot point, said pivot point being located on the housing so that it is on the strip center line when the apparatus is centered under rolled metal strips exiting a rolling mill, said top plate also being supported by projections on the underside of said top plate which bear against said load cells, said pivot point and said projections providing support which enables said top plate to pivot about an axis perpendicular with the centerline of metal strip in a direction parallel to the centerline of metal strip;

a cylindrical roller mounted on the topside of said top plate through bearings and independent support means at each end thereof, said cylindrical roller providing for support of rolled metal strip exiting a rolling mill when said apparatus is centered under rolled metal strip exiting a rolling mill so that any difference in tension across the width of strip may be detected by said load cells by pivoting of said top plate about an axis parallel to the centerline of rolled metal strip caused by curvature of strip which is translated through said cylindrical roller and said plate to said load cells.

2. The apparatus of claim 1 further comprising:

a flexible membrane covering the open top of said housing and said load cells, whereby said projections bear against said load cells through said flexible membrane.

3. The apparatus of claim 1 further comprising:

means for generating a first voltage signal corresponding to the total force asserted by the metal strip against said cylindrical roller; and means for generating a second voltage signal corresponding to any difference between the loading on one of said cells and the loading on second of said cells.

4. An apparatus for monitoring the flatness of a moving metal strip, said apparatus comprising:

a cylindrical roller for contacting metal strip exiting a rolling mill, said cylindrical roller being supported at opposite ends thereof by support means which in turn are supported by a plate;

said plate being supported on a pivot point located to coincide with the centerline of rolled metal strip when said apparatus is centered under rolled metal strip and by at least tow load cells for pressure detection positioned equidistantly from said pivot point, whereby any deviation of the flatness of rolled metal strip is transmitted through said roller by deflections of said plate to a least one of said load cells from which readings can be taken when metal strip engages said roller.

5. The apparatus of claim 4 wherein said load cells are in an open top housing and said plate has projections on its underside for contacting said load cells, said apparatus also including a flexible membrane covering the open top of said housing and said load cells, with said projections bearing against said load cells through said flexible membrane.

6. The apparatus of claim 5 further comprising:

means for generating a first voltage signal corresponding to the total force asserted by metal strip against said cylindrical roller; and means for generating a second voltage signal corresponding to any difference between the loading on one of said cells and the loading on a second of said cells.

7. A process for monitoring the flatness of rolled metal strip under tension exiting a rolling mill comprising the following steps:

providing at least two load cells for pressure detection on opposite sides of the centerline of the moving metal strip;

supporting a plate carrying a sensing roll on said load cells and on a pivot point under the centerline of the moving metal strip;

causing said moving metal strip to bear against the sensing roll at a defined wrap angle; and providing means for processing voltage signals of the load cells to provide a measurement of the flatness of the rolled strip.

8. The process as set forth in claim 7 wherein the processing means measures the flatness of the rolled strip output by generating a first output signal corresponding to the total force asserted by the metal strip against said load cells and generating a second output signal corresponding to any difference between the voltage signal of one of said cells and the voltage signal of the second of said cells.

* * * * *